US007281529B2

(12) United States Patent
Lew et al.

(10) Patent No.: US 7,281,529 B2
(45) Date of Patent: Oct. 16, 2007

(54) EGR COOLER PURGING APPARATUS AND METHOD

(75) Inventors: Mae L. Lew, Oak Park, IL (US); Wesley J. Terry, Worth, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 92 days.

(21) Appl. No.: 11/252,102

(22) Filed: Oct. 17, 2005

(65) Prior Publication Data

US 2007/0084206 A1 Apr. 19, 2007

(51) Int. Cl.
*F28G 11/00* (2006.01)

(52) U.S. Cl. ..... 123/568.12; 60/605.2; 137/625.48; 251/209

(58) Field of Classification Search ..... 60/605.2; 123/568.12; 137/625.48; 251/209
See application file for complete search history.

(56) References Cited

U.S. PATENT DOCUMENTS 4,249,382 A * 2/1981 Evans et al. ..... 60/605.2
4,350,319 A * 9/1982 Kawata et al. ..... 251/65
4,593,748 A * 6/1986 Kramb ..... 165/51
5,669,365 A * 9/1997 Gartner et al. ..... 123/568.12
6,205,785 B1 * 3/2001 Coleman ..... 60/605.2
6,378,509 B1 * 4/2002 Feucht et al. ..... 123/568.12
6,543,427 B2 * 4/2003 Kawasaki ..... 123/568.12
2006/0021346 A1 * 2/2006 Whelan et al. ..... 123/568.12

* cited by examiner

*Primary Examiner*—Thomas Denion
*Assistant Examiner*—Mary A Davis
(74) *Attorney, Agent, or Firm*—Jeffrey P. Calfa; Gerald W. Askew

(57) ABSTRACT

An apparatus for an internal combustion engine (200) includes a base engine (201) having an intake system (217) and an exhaust system (209). A turbine (203) has an inlet in fluid communication with the exhaust system (209), and an outlet. A first exhaust gas recirculation (EGR) cooler (211) fluidly communicates with the intake system (217) and the exhaust system (209) of the engine (200). An EGR valve (213) is in fluid communication with the EGR cooler (211), and a purge valve (205) is in fluid communication with the EGR cooler (211) and the outlet of the turbine (203).

20 Claims, 5 Drawing Sheets

- PRIOR ART -

EGR COOLER PURGING APPARATUS AND METHOD

FIELD OF THE INVENTION

This invention relates to internal combustion engines, including but not limited to engines having cooled exhaust gas recirculation (EGR).

BACKGROUND OF THE INVENTION

Internal combustion engines with EGR, especially compression ignition engines, typically employ EGR coolers. EGR coolers are heat exchangers that typically use engine coolant to cool exhaust gas being recirculated into the intake system of the engine. Engine exhaust gas typically includes combustion by-products, such as unburned fuel, many types of hydrocarbon compounds, sulfur compounds, water, and so forth.

Various compounds may condense and deposit on interior surfaces of engine components when exhaust gas is cooled. The EGR cooler is especially prone to condensation of compounds in the exhaust gas passing through it. The condensation is especially evident during cold ambient conditions, low exhaust gas temperatures, and/or low exhaust gas flow rates through the EGR cooler. Condensation inside the EGR cooler, or fouling, decreases the percent-effectiveness of the EGR cooler. EGR coolers are designed to cope with condensation of hydrocarbons by incorporating anti-fouling features, such as appropriate geometries that inhibit excessive accumulation of condensates and a designed-in extra capacity that is intended to be lost to fouling during service of the cooler.

The incorporation of anti-fouling features, and the increased size of EGR coolers make cooler design complicated and costly. Accordingly, there is a need for an EGR system having an EGR cooler that is able to maintain higher efficiency without requiring complicated anti-fouling mechanisms or an increased cooler size.

SUMMARY OF THE INVENTION

An apparatus for an internal combustion engine includes a base engine having an intake system and an exhaust system. A turbine has an inlet and an outlet. The inlet of the turbine is in fluid communication with the exhaust system. A first exhaust gas recirculation (EGR) cooler fluidly communicates with the intake system and the exhaust system of the engine. An EGR valve is in fluid communication with the EGR cooler, and a purge valve is in fluid communication with the EGR cooler and the outlet of the turbine.

A method includes the steps of collecting exhaust gas in a volume, monitoring operation of an engine and determining whether a purge event is to occur. If a purge event occurs, a purge valve is opened to fluidly connect an exhaust gas recirculation (EGR) cooler with an exhaust system and an outlet of a turbine.

DESCRIPTION OF A PREFERRED EMBODIMENT

Figure 1:
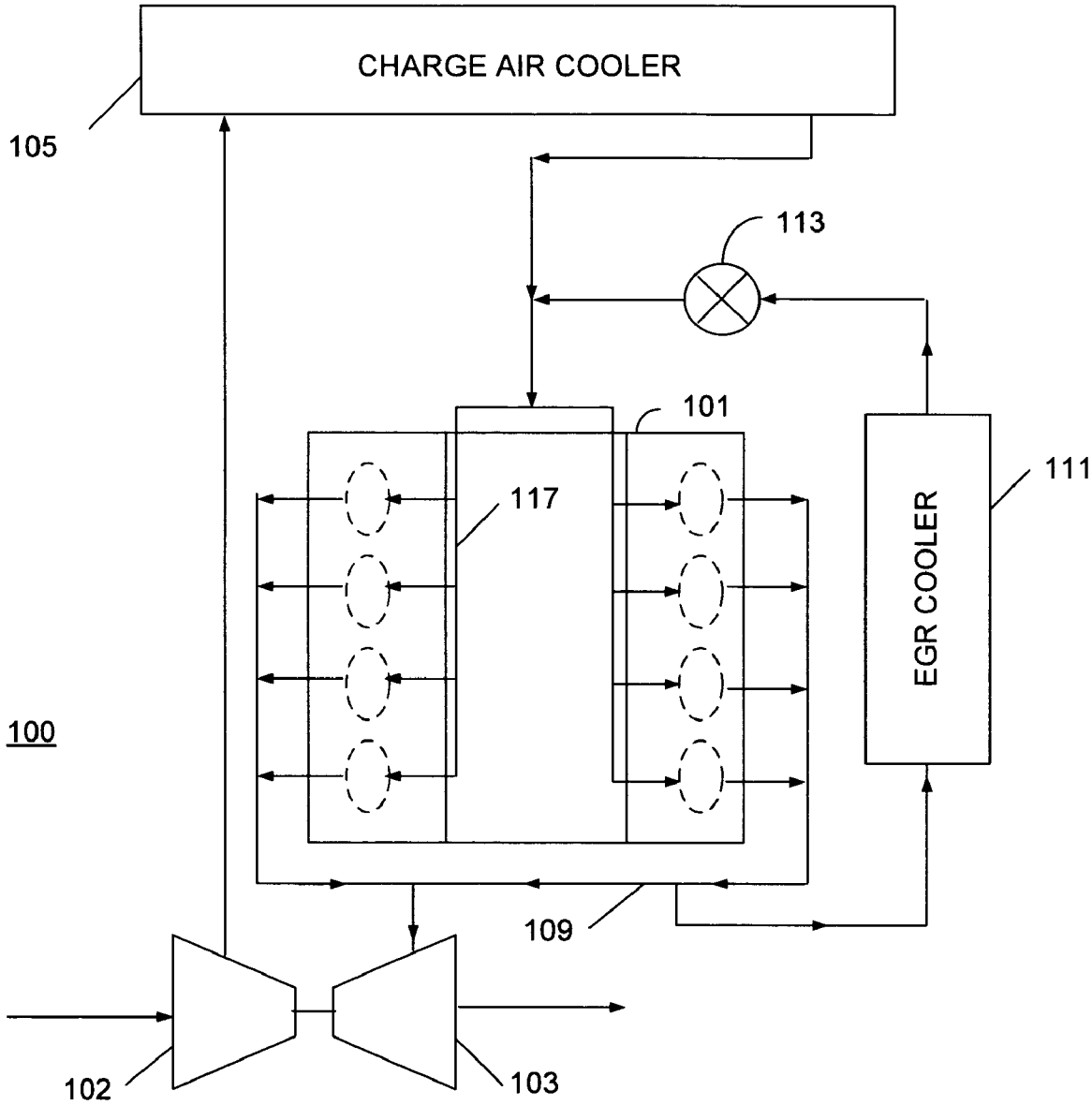
FIG. 1 is a block diagram of an internal combustion engine having a high-pressure EGR system.

The following describes an apparatus for and method of cleaning or purging an EGR cooler in an internal combustion engine. The engine includes an EGR system having an EGR cooler fluidly communicating with the engine. A lock diagram of an engine having a high-pressure EGR system is shown in FIG. 1. A base engine 100 contains a plurality of cylinders housed in an engine block 101. A compressor 102 is connected to an air cleaner (not shown) and a turbine 103. An outlet of the compressor 101 is connected to a charge cooler 105, which in turn is connected to an intake system 117. The turbine 103 is connected to an exhaust system 109. The exhaust system 109 is connected to the engine block 101, and also connected to an EGR cooler 111. The EGR cooler 111 is connected to an EGR valve 113.

During engine operation, air from the air cleaner (not shown) enters the compressor 102. Exhaust gas from the engine block 101 enters the exhaust system 109. A portion of the exhaust gas in the exhaust system 109 operates the turbine 103, and a portion enters the EGR cooler 111. The exhaust gas entering the turbine 103 forces a turbine wheel (not shown) to rotate and provide power to a compressor wheel (not shown) that compresses air. The compressed air travels from the output of the compressor 102 to the charge air cooler 105 where it is cooled. The cooled compressed air is then ingested by the engine through the intake system 117.

Exhaust gas entering the EGR cooler 111 is cooled before entering the EGR valve 113. The EGR valve 113 is shown downstream of the EGR cooler 111, but may alternatively be positioned upstream of the EGR cooler 111. The EGR valve 113 controls the quantity of exhaust gas the engine 100 will ingest. The exhaust gas exiting the EGR valve 113 mixes with the compressed and cooled air coming from the charge cooler 105 upstream of the intake system 117.

Figure 2:
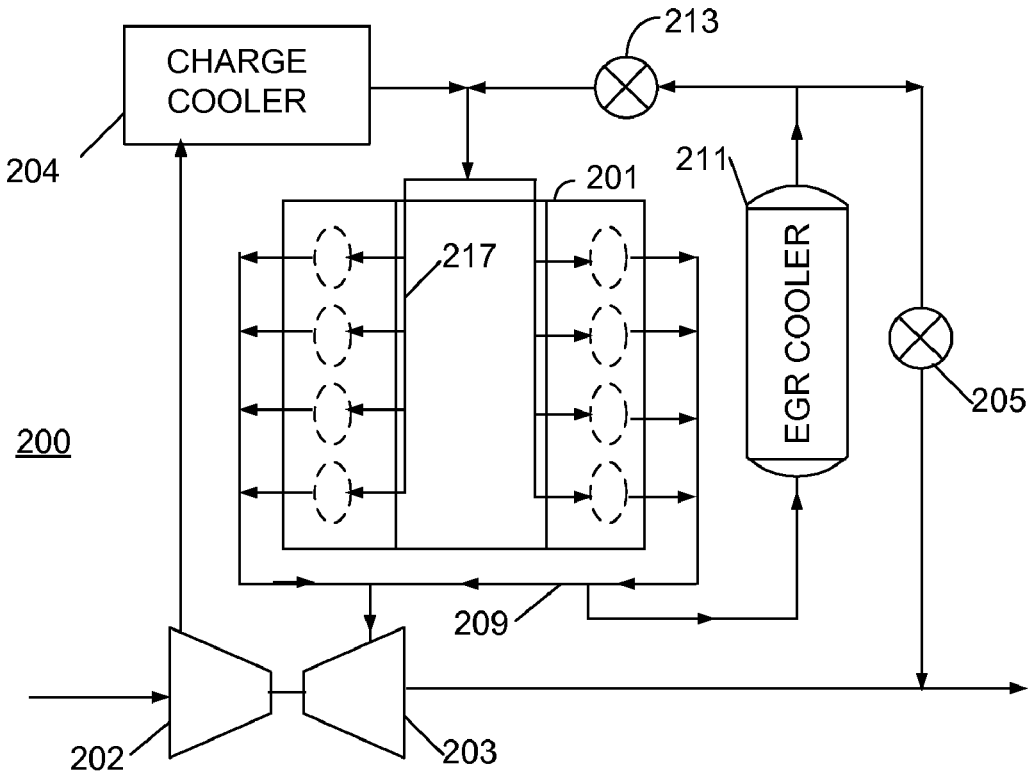
FIG. 2 is a block diagram of an internal combustion engine having a high-pressure EGR system with a purge valve in accordance with the invention.

An engine 200 having a system to purge an EGR cooler in an EGR system is shown in FIG. 2. The engine 200 includes an engine block 201 having a plurality of cylinders. A compressor 202 is connected to an air cleaner (not shown) and a turbine 203. An outlet of the compressor 202 is connected to a charge cooler 204, which in turn is connected to an intake system 217. A turbine 203 is connected to an exhaust system 209. The exhaust system 209 is connected to the engine block 201, and also connected to an EGR cooler 211. The EGR cooler 211 is connected to an EGR valve 213 and a purge valve 205. The EGR valve 213 and the purge valve 205 may be actuated by electrical, pneumatic, mechanical, hydraulic, or any other type of actuation mode known in the art. The purge valve 205 is in fluid communication with an outlet of the EGR cooler 211 on one end, and an outlet of the turbine 203 on another end. Even though one EGR cooler 211 is shown connected with the purge valve 205, additional EGR coolers may be utilized in a serial or parallel arrangement may use additional purge valves.

The purge valve 205 is shown in fluid communication with the EGR valve 213, but may not be directly connected to the EGR valve 213 if the EGR valve 213 is not in fluid communication with the outlet of a single EGR cooler 211, but is instead disposed at another location, for example, at the outlet of a first EGR cooler in the presence of at least a second EGR cooler. In such a case, the purge valve 205 could be disposed at the outlet of the second EGR cooler.

During engine operation, exhaust gas from the exhaust system 209 enters the EGR cooler 211 where it is cooled, and then enters the EGR valve 213. When the EGR valve 213 is open, the purge valve 205 is advantageously closed so as to prevent leakage of exhaust gas across the turbine 203. In the case where the engine 200 also has emission after-treatment components, such as a particulate filter or a catalyst (not shown) in fluid communication with the outlet of the turbine 203, the purge valve 205 may be at least partially opened to facilitate an increase of temperature, flow rate, pressure, or change transient conditions in the exhaust gas at the outlet of the turbine 203.

At certain occasions or events during engine operation, the purge valve 205 may open while the EGR valve 213 is advantageously closed, to purge exhaust gas from the exhaust system 209 into the outlet of the turbine 203. The exhaust gas being purged advantageously passes through the EGR cooler 211. The exhaust gas being purged induces the EGR cooler to undergo a sudden thermal gradient. This thermal gradient causes deposits within the EGR cooler and other engine components to crack and separate from the surfaces it has deposited on. The separated material from the deposits is then carried off by the purge exhaust gas, and is disposed-of downstream from the outlet of the turbine 203. In the case where the engine 200 also has a particulate filter downstream of the turbine 203, the separated material is advantageously trapped in the filter.

The purging of an EGR cooler had tremendous and unexpected effects in increasing the efficiency of the EGR cooler in situations when the cooler efficiency would have been low. A graph of three engine parameters: exhaust gas temperature at the inlet of an EGR cooler, exhaust gas temperature at the outlet of the EGR cooler, and the calculated (%) efficiency of the EGR cooler, are plotted with respect to time in FIG. 3. The horizontal axis represents elapsed time, measured in hours, the vertical axis on the left is scaled for temperature of exhaust gas measured in degrees F, and the vertical axis on the right is scaled for EGR cooler effectiveness, expressed in terms of percentage (%) and defined as:

$$Eff\ (\%) = 100 * \frac{Tgas_{in} - Tgas_{out}}{Tgas_{in} - Twater_{in}}$$

where T-gas-in, and T-gas-out, are the exhaust gas temperatures at the inlet and the outlet respectively of the EGR cooler, and (assuming the EGR cooler uses engine coolant or water to cool the exhaust gas,) T-water-in is the temperature of the coolant at the inlet of the EGR cooler.

Figure 3:
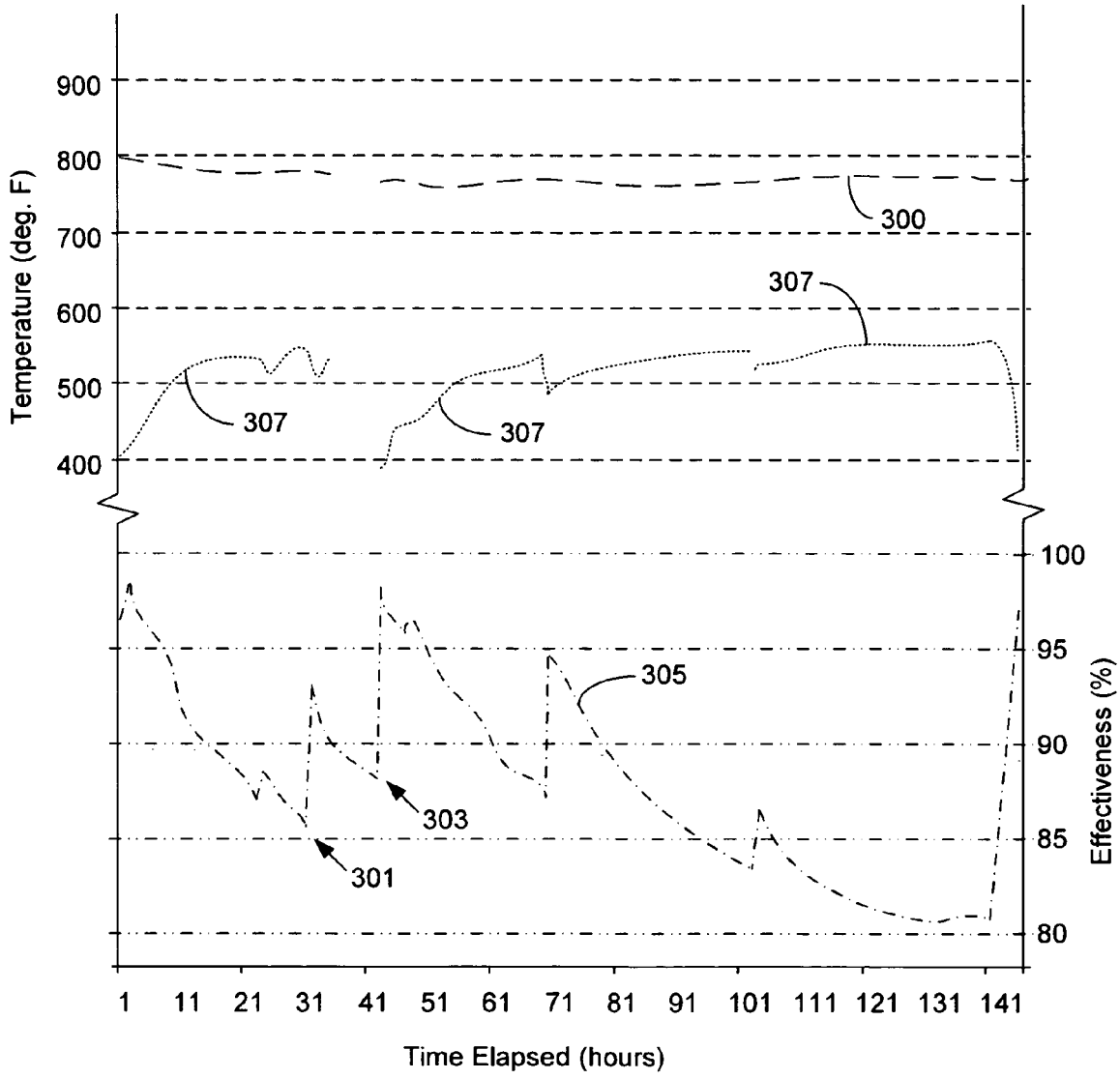
FIG. 3 is a time trace of engine related parameters in accordance with the invention.

As it can be seen in FIG. 3, the experiment ran for about 145 hours using the same engine and EGR cooler, and running the engine under special fouling conditions. The temperature of exhaust gas at the inlet of the EGR cooler, shown in the long-dashed-line trace 300, was kept substantially unchanged during the course of the experiment between 750 to 800 degrees F. (400 to 427 degrees C.). The EGR cooler accumulated deposits during the test, and the purge valve was periodically cycled to observe the effect on the percent (%) effectiveness 304 of the EGR cooler. The purge valve was cycled for the first time at point 301, after the experiment had run for about 31 hours. The effectiveness of the EGR cooler is represented by the line-dot-line trace 305. The effectiveness of the EGR cooler had reduced from about 97% at the start of the experiment, to about 87% before the purge valve was opened. Within a few minutes of the purge valve opening, the EGR cooler effectiveness climbed to about 93%, and after about 10 more hours the purge valve was opened again at point 303, about 41 hours into the experiment, raising the effectiveness of the EGR cooler back to about 97%, or to about the same level as the effectiveness of the cooler at the start of the experiment.

The opening and closing of the purge valve at point 301 and at point 303 created a "blast" of exhaust gas flow that cleaned out the deposits from the EGR cooler. Advantageously, a period of no gas flow through the EGR cooler preceding a cycling of the purge valve changed the heat transfer characteristics of the deposits such that an interface layer of deposits softened to allow the blast of flow resulting from the opening of the purge valve to become more effective in cleaning out deposits from the EGR cooler. The temperature of exhaust gas exiting the EGR cooler is also shown on the chart, indicated by the short-dashed-line trace 307. The temperature of exhaust gas at the outlet of the EGR cooler advantageously decreases with every increase of the percent effectiveness of the cooler, as can be expected.

As shown in the same chart, subsequent openings of the purge valve succeeded in increasing the effectiveness of the EGR cooler relatively instantaneously. Factors affecting the increase of effectiveness of the EGR cooler include the frequency and duration of the purge valve openings, and the purging exhaust gas temperature and flow rate. Advantageously larger increases in efficiency may be accomplished by increasing the frequency and duration of the purge valve openings, at times when the engine operating condition avails more exhaust gas at a higher temperature.

Figure 4:
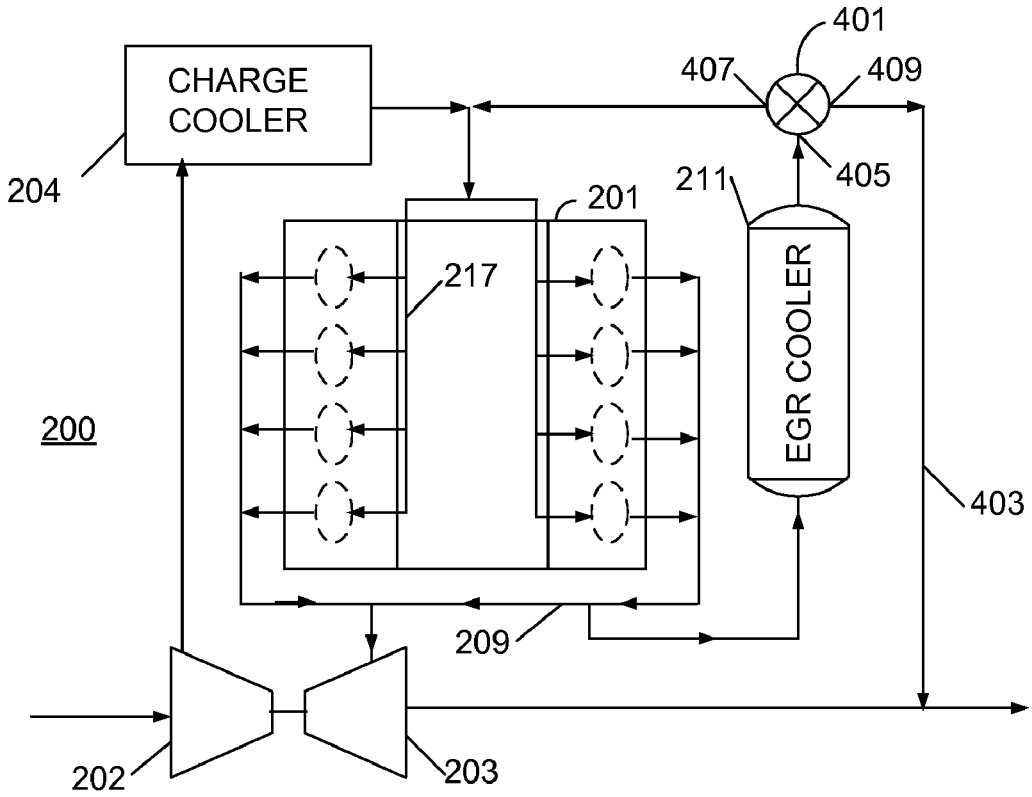
FIG. 4 is a block diagram of an internal combustion engine having a high-pressure EGR system with a three-way valve in accordance with the invention.

An alternative embodiment using a single three-way valve 401 is shown in FIG. 4. The three-way valve 401 fluidly connects the EGR cooler 211 with the intake system 217, the outlet of the turbine 203, and the exhaust system 209. The three-way valve 401 is capable of modulating or controlling exhaust gas flow passing through the EGR cooler 211, in addition to selecting at least on of the intake system 217 and a purge path 403 to receive exhaust gas. The three way valve 401 has a gas inlet 405, an EGR outlet 407, and a purge outlet 409. It is advantageous to select one of the two possible paths for exhaust gas to flow after passing through the EGR cooler 211, but a combination of selecting both paths might be beneficial to the operation of the engine at different times, for example, to enable control of a constant exhaust gas temperature out of the EGR cooler. The configuration of a separate purge valve and EGR valve shown in FIG. 2, or the combination of the two valves into one three way valve as shown in FIG. 3, are indicative of two potential configurations, and are not intended to limit the scope of the invention. One skilled in the art may realize that any number of valves and/or other flow control devices may be used in any configuration capable of fluidly connecting an EGR cooler with an intake system and an outlet of a turbine on an engine may be used to realize the advantages of this invention.

Figure 5:
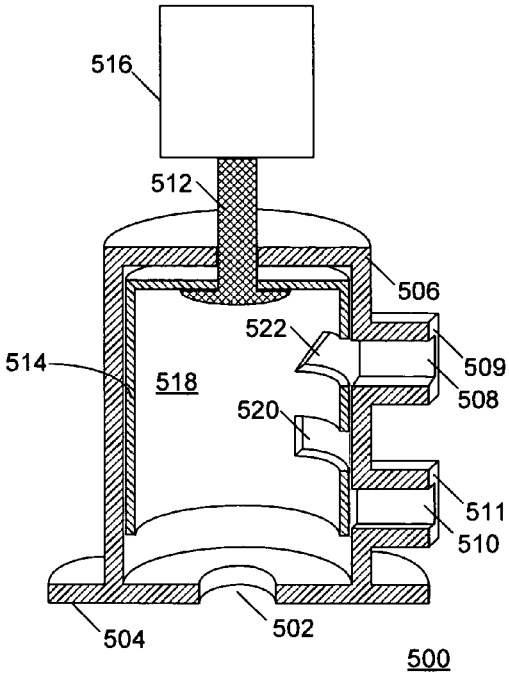
FIG. 5 is a section view of a valve in accordance with the invention.

A three-way valve 500 that may be suitable for the function of the three-way valve 401 is shown in FIG. 5. The three-way valve 500 has a gas inlet 502 with a connection flange 504. The connection flange 504 connects to a source of cooled exhaust gas from the engine. The connection flange 504 is part of a valve housing 506. The valve housing 506 has an EGR outlet 508, and a purge outlet 510. Each of the outlets 506 and 508 have flanges 509 and 511 suitable for fluid connections to other components of an engine. A shaft 512 is connected to a gate member 514. An external actuator 516 is connected to the shaft 512.

The gate member 514 may have a substantially cylindrical shape, with an internal volume 518, a first opening 520, and a second opening 522. The first opening 520 may have a substantially rectangular shape, while the second opening 522 may have a substantially trapezoidal shape, as shown in the embodiment of FIGS. 5 and 7A.

Figure 6:
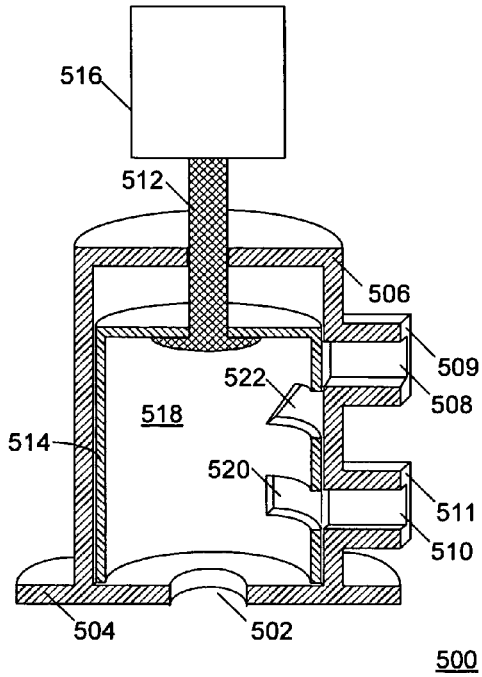
FIG. 6 is a section view of a valve in accordance with the invention.

During operation, exhaust gas enters the valve 500 through the gas inlet 502. The gas inlet 502 is in fluid communication with the internal volume 518. Depending on a position of the gate member 514 within the housing 506, the exhaust gas may exit either out of the EGR outlet 508, or the purge outlet 510. The position of the gate member 514 within the housing 506 shown in FIG. 5 is arranged for flow of exhaust gas from the inlet 502 to the EGR outlet 508. An alternative position for the gate member 514 within the housing 506 is shown in FIG. 6, where flow of exhaust gas entering the inlet 502 is arranged to exit from the purge opening 510.

When in an EGR mode, an effective flow area for exhaust gas exiting through the EGR outlet 508 is determined by an amount of flow area exposed between the tapered second opening 522 and the EGR outlet 508 opening in the housing 506. More exhaust gas will flow through the valve 500 when more flow area is exposed, and more area is exposed when the gate member 514 sits further away from the gas inlet 502 side of the housing 506 in the configuration shown. The valve 500 is closed when both the first opening 520 and the second opening 522 are not aligned with either the EGR outlet 508 or the purge outlet 510. When the purge valve 500 is in a purge mode, exhaust gas from the internal volume 518 exits the purge outlet 510 when the first opening 520 is aligned with the purge outlet 510.

Figure 7A:
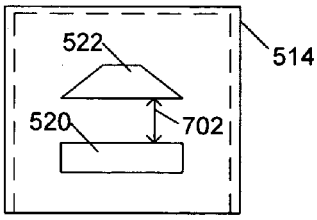
FIG. 7A through FIG. 7D are various alternatives for a gate member of a valve in accordance with the invention.

A front view of the gate member 514 removed from the valve 500 is shown in FIG. 7A. The rectangular shape of the first opening 520, and the trapezoidal shape of the second opening 522 can be seen. The first and second openings 520 and 522 may be separated by a distance 702. By adjustment of the distance 702 one may control a distance of travel of the gate member 514 within the valve 500, and may also advantageously determine a travel distance of the external actuator 516 that is suitable for use with the valve 500.

Figure 7C:
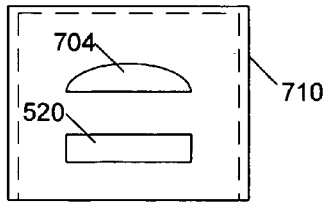
Figure 7B:
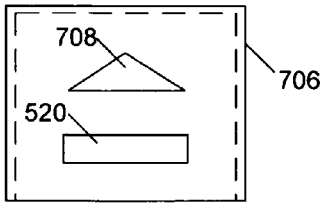
Figure 7D:
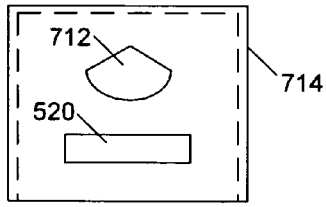

Alternative shapes may be used for the second opening 522, as presented in FIG. 7B through FIG. 7D. A triangular second opening 708 on an alternative gate member 706 is presented in FIG. 7B. A semi-elliptical second opening 704 on an alternative gate member 710 is presented in FIG. 7C. A tear-drop shaped second opening 712 on an alternative gate member 714 is presented in FIG. 7D. The alternative shapes for the second opening 704, 708, and 712, are illustrations of some of the alternative shapes that may be used. The shape selected for the second opening 508 may also be a simple rectangular or circular shape. Shapes like the ones presented in FIG. 7A through FIG. 7D advantageously enable the valve 500 to finely control a flow of exhaust gas through the opening 508 because a relationship between a position of the gate member 514, 706, 710, and 714 within the housing 506 and exposed flow area may advantageously be a non-linear relationship.

Figure 8:
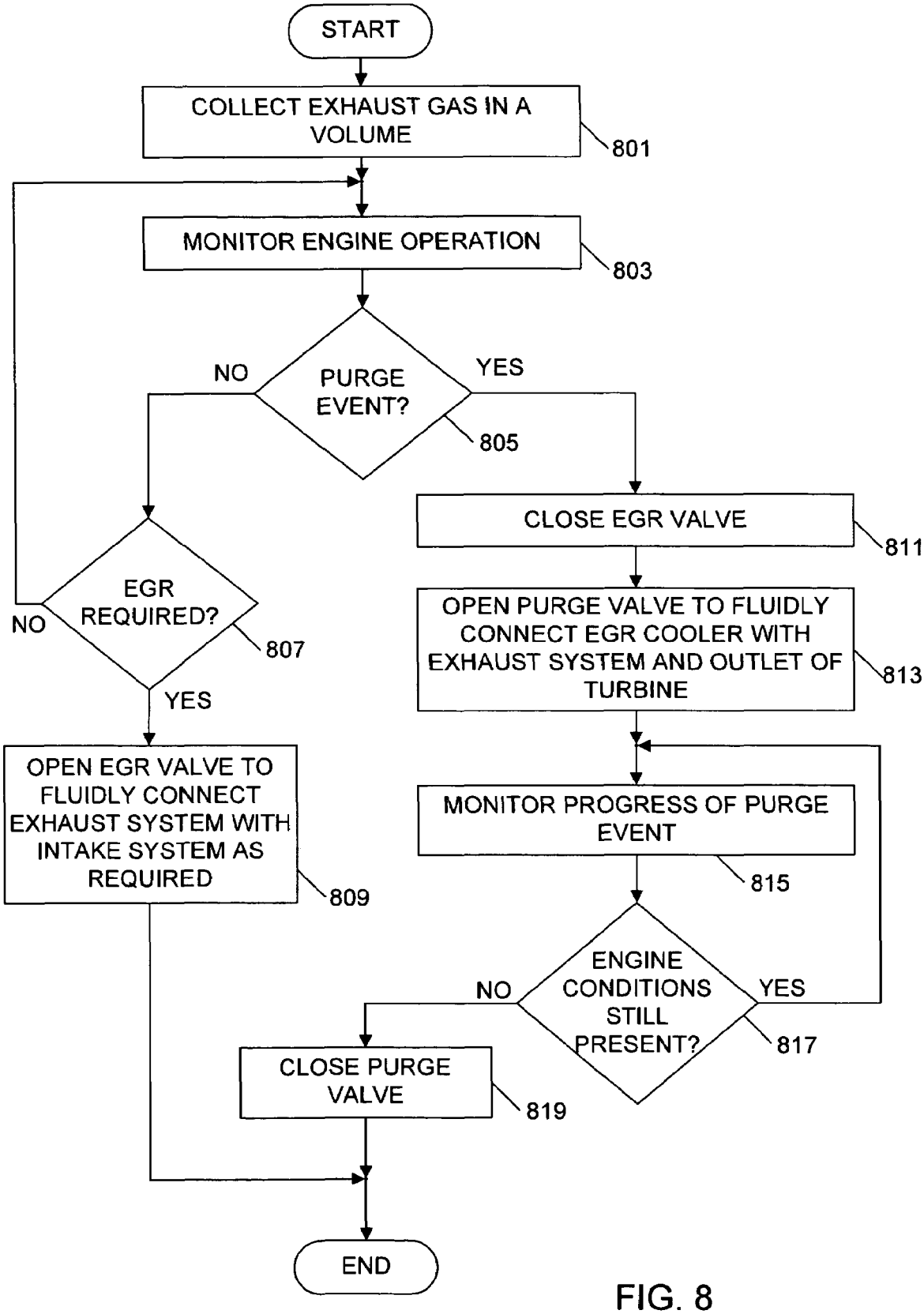
FIG. 8 is a flowchart for a method in accordance with the invention.

A method for purging an EGR cooler for an internal combustion engine is shown in FIG. 8. Exhaust gas is collected in a volume in step 801. An engine controller monitors the operation of an engine in step 803, and determines whether a purge event should occur in step 805. If a purge event does not occur, the engine controller determines whether EGR is required in step 807. If EGR is required, an EGR valve is opened, to fluidly connect an exhaust system with an intake system of the engine in step 809. If EGR is not commanded, the process repeats starting back at step 803.

If a purge event does occur, the process at step 805 continues with step 811, where the EGR valve is closed. The purge valve is opened to fluidly connect the EGR cooler with the exhaust system of the engine and an outlet of a turbine in step 813. While the purge valve is open, the engine controller monitors the progress of the purge event in step 815. If engine conditions conducive to an effective purge event are still present, the purge event is allowed to complete with an affirmative decision in step 817. If conditions conducive to an effective purge event are not still present, a negative decision from step 817 closes the purge valve at step 819.

The determination of whether a purge event is to occur in step 805 depends on engine operating conditions. Enabling conditions for a purge event are advantageously not intrusive to the operation of the EGR valve or the engine, and occur at times when the opening of the purge valve will be virtually imperceptible to the operator of the vehicle. Such enabling conditions may occur, for example, when the engine first starts up, when the engine is being serviced and operates under a service mode and/or a diagnostic mode of operation, or when the engine is operating at a high speed without fueling, for instance, when the engine is coasting, or more advantageously, when the vehicle is rolling to a stop or down a hill. The operator may be advantageously also advised of the occurrence of the purge event by an indication on the dash panel of the vehicle, so as not to be alarmed by a different noise of the engine during a purging event.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus for an internal combustion engine comprising:

a base engine having an intake manifold and an exhaust manifold;

a turbine having a turbine inlet in fluid communication with the exhaust manifold, and a turbine outlet;

a first exhaust gas recirculation (EGR) cooler having a cooler outlet fluidly communicating with the intake manifold and a cooler inlet fluidly communicating with the exhaust manifold and with the turbine inlet;

an EGR valve in fluid communication with the EGR cooler; and a purge valve disposed in fluid communication between the EGR cooler outlet and the turbine outlet.

2. The apparatus of claim 1, wherein the EGR valve and the purge valve are integrated into a single valve.

3. The apparatus of claim 2, wherein the single valve includes a gate member having a first opening and a second opening.

4. The apparatus of claim 3, wherein at least one of the first opening and the second opening has at least one of a rectangular, trapezoidal, triangular, semi-circular, and tear-drop, shape.

5. The apparatus of claim 1, further comprising an electronic engine controller.

6. The apparatus of claim 1, further comprising a purge valve actuator, wherein the purge valve actuator is actuated by at least one of electrical, pneumatic, and mechanical power.

7. The apparatus of claim 1, wherein the EGR valve and the purge valve are contained in a three-way valve.

8. The apparatus of claim 1, wherein the base engine includes a plurality of cylinders in fluid communication with the intake manifold and the exhaust manifold.

9. The apparatus of claim 1, further comprising a compressor connected to the turbine and in fluid communication with the intake manifold.

10. A method comprising the steps of:

monitoring operation of an engine;

determining whether to purge an exhaust gas recirculation (EGR) cooler; and when purging an EGR cooler, opening a purge valve to fluidly connect an inlet of the EGR cooler with an exhaust system upstream of a turbine, and fluidly connecting an outlet of the EGR cooler direct to an outlet of the turbine.

11. The method of claim 10, further comprising the step of opening an EGR valve to fluidly connect the exhaust system with an intake system.

12. The method of claim 10, further comprising the step of closing an EGR valve before opening the purge valve.

13. The method of claim 10, further comprising the step of checking whether purging engine conditions are present.

14. The method of claim 13, further comprising the step of closing the purge valve when engine purging engine conditions are not present.

15. The method of claim 10, further comprising the step of collecting exhaust gas in an internal volume of the purge valve.

16. A method for an internal combustion engine comprising the steps of:

opening a purge valve disposed at an outlet of an exhaust gas recirculation (EGR) cooler to fluidly connect the outlet of the EGR cooler with an outlet of a turbine, wherein an inlet of the EGR cooler is in direct fluid communication with an inlet of the turbine;

closing an EGR valve disposed in fluid communication with the outlet of the EGR cooler and an intake system of the engine.

17. The method of claim 16, wherein the opening and closing steps are performed when the engine is in a start-up mode.

18. The method of claim 16, wherein the opening and closing steps are performed when the engine is in a service mode of operation.

19. The method of claim 16, wherein the opening and closing steps are performed when the engine is in a diagnostic mode of operation.

20. The method of claim 16, wherein the opening and closing steps are performed when the engine is in a non-fueling mode of operation.

* * * * *